US010645993B1

(12) United States Patent
Cheskin

(10) Patent No.: US 10,645,993 B1
(45) Date of Patent: May 12, 2020

(54) SYSTEM AND METHOD FOR AN ARTICLE OF FOOTWEAR WITH ELECTROSTATIC AND ENDOGENOUS CURRENT CONDUCTING INSERT

(71) Applicant: Melvyn Cheskin, Deerfield Beach, FL (US)

(72) Inventor: Melvyn Cheskin, Deerfield Beach, FL (US)

( * ) Notice: Subject to any disclaimer, the term of this patent is extended or adjusted under 35 U.S.C. 154(b) by 0 days.

(21) Appl. No.: 16/411,527

(22) Filed: May 14, 2019

Related U.S. Application Data

(63) Continuation-in-part of application No. PCT/US2018/058384, filed on Oct. 31, 2018.

(51) Int. Cl.
*A43B 7/36* (2006.01)
*A43B 13/38* (2006.01)

(52) U.S. Cl.
CPC ..... *A43B 7/36* (2013.01); *A43B 13/386* (2013.01)

(58) Field of Classification Search
CPC ..... A43B 7/36; A43B 13/386
USPC ..... 361/220, 224
See application file for complete search history.

(56) References Cited

U.S. PATENT DOCUMENTS 2,857,556 A * 10/1958 Price ..... A43B 7/36 361/224
4,127,552 A * 11/1978 Bidston ..... A43B 7/36 260/DIG. 15
5,653,047 A * 8/1997 Franey ..... A43B 7/36 36/136

* cited by examiner

*Primary Examiner* — Dharti H Patel
(74) *Attorney, Agent, or Firm* — Melvin K. Silverman

(57) ABSTRACT

A static electricity discharging shoe with conductive link to ground having a conductive insole contacting with a sole of a foot of a user, and a conductive outer sole contacting with a ground; and an electro-conductive insert, having an upper major and a lower minor base, the insert in electrical communication between the insole and the outer sole, the insert having a lateral geometry proportioned for complemental engagement within a mid-sole situated between the insole and the outer sole, a narrow middle portion of the insert secured within the mid-sole, the upper surface of the insert positioned opposite to the plantar metatarsal region of the sole of the foot proximally to the K-1 acupressure point when the foot abuts the insole, the upper surface of the insert defining a slightly raised pad, having orthopedic benefit in off-loading of metatarsal stresses on the foot in the area of the K-1 point.

19 Claims, 8 Drawing Sheets

SYSTEM AND METHOD FOR AN ARTICLE OF FOOTWEAR WITH ELECTROSTATIC AND ENDOGENOUS CURRENT CONDUCTING INSERT

CROSS REFERENCE TO RELATED APPLICATIONS

This application is a continuation-in-part of International Application No. PCT/US2018/058384, filed 31 Oct. 2018, and the same is incorporated by reference in its entirety.

BACKGROUND OF THE INVENTION

The present invention relates to grounding systems. More particularly, the invention relates to a personal two-way grounding system for collecting beneficial free electrons from the earth's surface and removing harmful EMF's and static electricity from the human body.

By way of definition, static electricity is the accumulation of electric charge in an insulated body, most frequently caused by friction, but also by other means, such as induction and atmospheric factors of an electrical character from all around us (e.g. computers to ac appliances to cell phones electrostatic discharge (ESD) is the transfer of electric charge between two bodies, often accompanied by a visible spark, as in the familiar phenomenon of doorknob shock. While electrostatic discharge per se may not be immediately harmful to the body, it is at least at levels of voltage less than about 3000 volts, discharges whether visible or not of much smaller voltages are known to be damaging at various biological levels.

When the body makes physical contact with the ground, as has been the case throughout human evolution, it naturally attenuates the positive electrical charges on the body and transfers the negative electrical properties from the earth so that the body becomes electrically neutral like the earth. In this state any extraneous electricity that is present in or on the body is naturally dissipative and thereafter prevented from accumulating in or upon the body. Furthermore, negative free electrons that are abundant on the earth's natural surface are transferred into the body. This free electron transfer from the earth into the body is responsible for the proper function of many metabolic processes in the human body and in maintaining its health. It is also responsible in maintaining a beneficial homeostatic balance in the body resulting in optimal physiological performance. Due to the common practice today of wearing insulating rubber soled shoes and living in environments that hold the body in free space above the earth, humans by and large no longer make contact with the earth. As a result, free electrons whether internally or externally generated cannot be naturally dissipated by the negative electrical potential of the earth. Consequently, bodily stored electricity now interferes with normal cellular communications and, as such, interferes with the self-regulating and self-healing mechanisms of the body, which in turn create stress, disorder and other malfunctions of the body.

More specifically, with the loss of natural ground contact, externally-originating electric and magnetic fields (EMFs) create harmful electric currents in the body. Scientists and researchers in the field of electromagnetic radiation and bio-electromagnetics have confirmed that these exogenous fields interfere with the endogenous fields of the body and produce adverse physical changes at the cellular level. It has been found that the unnatural presence of these currents and continuously generated electrostatic charges and discharges within and on the body adversely affects the bioelectrical nervous system of the body and consequently causes body muscles to become weaker and remain abnormally tense. Prolonged exposure to such electrostatic charges can result in muscle stiffness and back pain. In this physiologically stressed state, blood pressure rises, heart rate increases and the digestive process slows. It is believed that the unnatural presence of endogenous currents and electrostatic charges in the body may also have a correlation with certain diseases related to chronic inflammation, such as arthritis, diabetes and multiple sclerosis amongst others.

The footwear provided in accordance with the invention exhibit an electro-conductive insole which contacts the foot and an outsole electrically connected with the insole by insert/plug of a conductive material having a grounding area. The footwear of the present invention may take the form of multiple shoe types. The invention is particularly applicable to sports shoes, working shoes, sandals, and nurse shoes in all climates and specifically in and climates in which people are affected to a more considerable extent by static electricity. Furthermore, in medical and therapeutic footwear the invention has proven to be effective in helping to improve specific pathologies and medical conditions.

The present shoes with conductive metatarsal plug prevent fatigue brought by accumulated static electricity, endogenous charges or injuries caused by discharges of static electricity and by energizing the body with free electron transfer from the earth. For instance, athletes or players who use shoes of the instant type experience less fatigue and enhanced endurance.

In general, the sole of all shoes is composed of an insole just under the foot, an outsole which contacts the ground and a mid-sole between the insole and the outsole. The insole of the shoes of the present invention have at least a function of transfer of static electricity generated in a human body during walking or running to a grounding area of the outsole. In lieu of the above, a sandal may be employed having a single sole but with the inventive insert strategically located in the metatarsal region near to the K1 acupressure point, proximal to the metatarsal area.

The instant invention responds to a long-felt need in the art to provide a more cost and functionally efficient solution to the issues of ESD and endogenous currents having an external atmospheric source.

Prior art, known to the Inventors that attempt to address issues of ESD using a shoe-related solution are U.S. Pat. No. 6,982,861 (2006) to Lex et al; U.S. Pat. Appln. Pub. US 2007/0000155 (2007) TO Laufer et al; U.S. Pat. Appln. Pub. US 2008/0134546 (2008) to Rigletto; U.S. Pat. Appln. Pub. US 2008/0289217 (2008) to Horvath; PCT Publication WO 98/25492 to Fukimura (1988); PCT Publication WO/00/04801 (2000) to Janke; Japanese Patent JPH05228003A (1992) to Miyagi. This does not teach use of a conductive insert of the type taught herein that addresses ESD endogenous current, and provides the orthopedic and other physiologic benefits of the within invention.

Omega Shoe Manufacturers of Greece sells a shoe having a copper insert within the outer sole thereof, this under the brand name GEOSES. Further <www.Juil.com> is another company in the U.S.A using a copper insert to connect the human body to the earth. Copper is a high-level conductor but generally not optimal in physiologic applications in footwear and entails certain safety risks.

SUMMARY OF THE INVENTION

The instant invention provides for a shoe having a special-purpose metatarsal pad and insert that further relates to a method to relieve orthopedic injuries of the foot and to reduce and prevent chronic inflammation and other illnesses in humans; as well as to enhance physiological performance by the establishment of electrical communication to the ground by discharging electrostatic discharge and endogenous currents of external origin namely free electrons from the earth. The shoe includes a resilient conductive insert having a raised metatarsal pad connected, from the outsole, to a sock liner or the insole of the shoe. The insert functions both as a recognizable pedorthic off-loading pad against the plantar surface of the foot situated immediately proximally to the metatarsal, and concurrently facilitates conductivity with the major acupuncture point also known as the K-1 acupressure point which corresponds to the kidney and other nerve endings in the human foot, these constituting a recognized exit for the conduction of free radicals to the surface of the earth, i.e., the release of charged static electricity from the human body to the earth.

The instant invention also provides a method for conducting a two-way electrical conduit between body and ground through use of a static electricity discharging article of footwear with a conductive link to ground. This is done by configuring a conductive insole of an article of footwear for contact with a sole of a foot of a user, and configuring a conductive outer sole of an article of footwear for contact with a ground, providing a dissipative, raised, electro-conductive insert having an upper major and a lower minor base, situating said electro-conductive insert between said insole and said outer sole, wherein said insole and said outsole are in electrical communication, situating a mid-sole between said insole and said outer sole, configuring said electro-conductive insert to have a lateral geometry proportioned for complemental engagement within said mid-sole, placing a narrow middle portion of said electro-conductive insert secured within said mid-sole, configuring said upper major base of said electro-conductive insert by positioning said upper major base of said electro-conductive insert opposite to the plantar metatarsal region of the sole of the foot proximally to the K-1 acupressure point when the foot abuts the insole, said upper major base of the electro-conductive insert defining the raised insert, and using an elastomeric material for said insert.

The static electricity discharging shoe of the invention includes an optional conductive sock liner or insole contacting with a sole of a foot of a user; an outer sole conducting with the ground; and an electro-conductive insert having an upper base, said insert having a lateral geometry proportioned for circumferential engagement with at least said outer sole, said insert positioned opposite to the plantar region of the sole of the foot proximally to the K-1 acupressure point when the foot abuts the conductive insole, said upper base of the insert defining a slightly raised pad having orthopedic benefit in off-loading of metatarsal stresses on the foot in the area of the K-1 acupressure point.

It is an object of the invention to provide a two-way electrical link to the ground in an electrostatically dissipative shoe which provides increased comfort and physiological benefit to the metatarsal region, and plantar surface, which may be economically added to otherwise all other conventional footwear.

It is another object to provide an electrostatic discharge athletic shoe, which allows for the infusion of free electrons from the surface of the earth to be transferred in direct contact with the human body.

It is yet another object of the invention to provide added protection to the body from EMF's potential health hazard by dissipating excess electrostatic build up on the body into the ground.

It is still a further object of the invention to provide enhanced pedorthic off-loading to the plantar surface of the sole of the foot proximally to the metatarsal region.

It is an objective of the invention to achieve discharge of free radicals from an off-loading point.

It is yet further object to provide a shoe enabling a direct source of electrical contact substantially to provide constant pressure to the K-1 acupressure point that is, to a kidney-related coupling to the body.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

The ancient practice of medicine stresses the importance of man's harmonious relationship with earth and sky. In furtherance of this belief, modern science has established that the earth possesses an electromagnetic dynamic field, that is, a continually changing field and in which exists between the sky or atmosphere and the earth, the earth providing the negative charge of this field which the ionosphere is provided with the positive charges of the electromagnetic dynamics field. This has been established by Burr and Norhrup of Yale University and by Miculin of the University of Moscow.

A recognized natural phenomenon, known as the Schumann Resonance between the atmosphere and the core of the earth has been calculated to have a frequency of 7.9 Hz cycles per second, which correlates with the human alpha brain wave pattern of 8.0 Hz cycles per second in a relaxed state.

Figure 2:
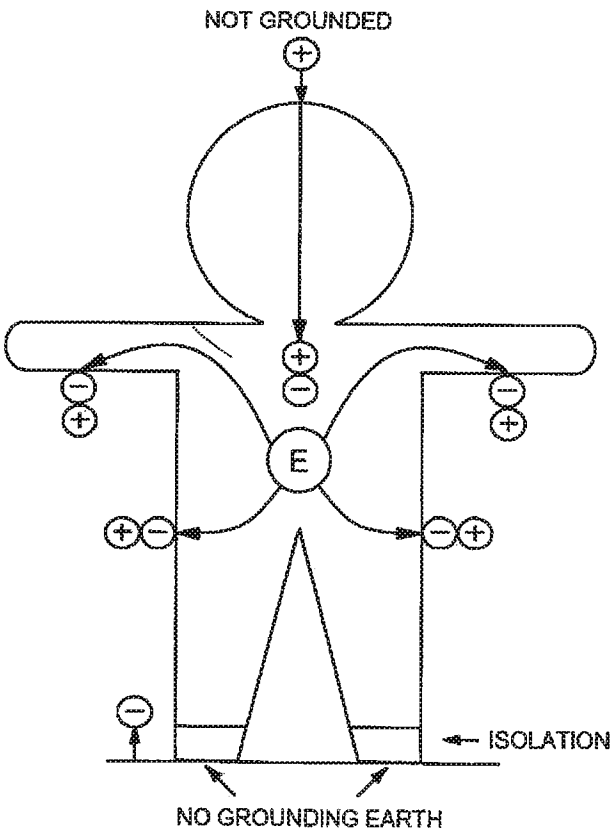
FIG. 2 is a non-grounding part of FIG. 1, showing the earth.
Figure 1:
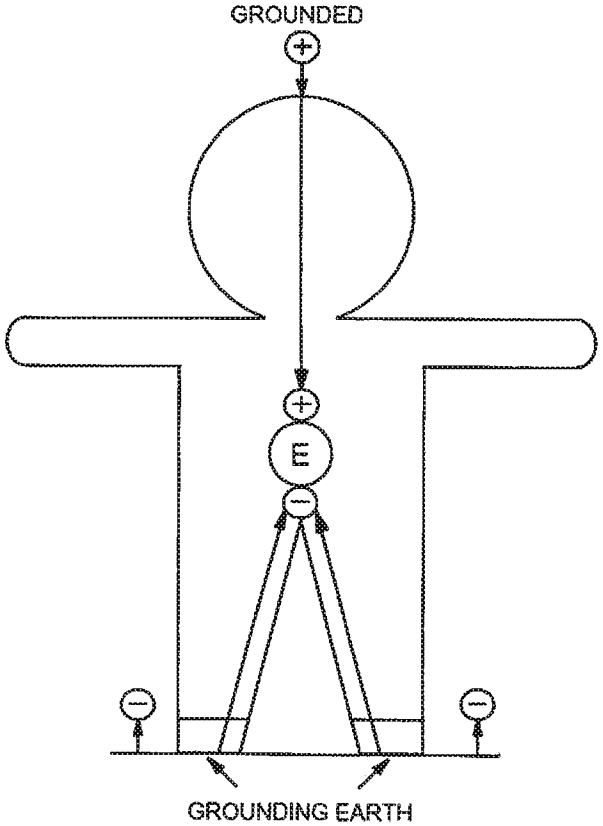
FIG. 1 is a schematic invention of a grounding part of the earth.

The above, as it relates to the instant invention, posits that man, as he walks upon the earth, absorbs, through his feet, negative charges while his head and rest of his body draw positive charges from the ionosphere. This is schematically shown in FIG. 1. These two opposing electrical charges balance each other (at area E) within the human body, contributing to one's physical wellbeing and optimal physical performance. However, if the negative charges become absent due to lack of contact with the earth, the body is forced to convert useful energy used by its chemical oxidation processes into a weak negative charge in an effort to compensate for the lack of negative charge which would normally enter the body through the earth. This resultant energy loss may manifest in neuro-muscular physical performance, mental fatigue, stress, and various cardiovascular issues. This condition of lack of physical conductivity with the earth is schematically shown in FIG. 2, showing the lack of equilibrium E when needed and potentially harmful positive and negative ions accumulate both in and upon the human body.

Stated otherwise, an evolutionary function of the earth is to maintain a satisfactory level of negative charge in humans, namely, homeostasis. Well-known in contemporary medicine is that the sole of one's foot constitutes a network of nerve endings connected to the body's vital organs such that, when proper grounding to the earth is present, direct neurologic benefit occurs throughout the entire body at a cellular level at least through this neural network. Given however the development of modern life in the last several hundred years, various factors have contributed to minimize or, in many instance, completely, negate, man's direct contact with the surface of the earth, i.e., his natural source of negative electrical charge to the body. However, in recent years, as is reflected in the prior art discussed above, researchers and others have begun to experiment with shoes intended to restore one's electrical contact with the earth to enable one to more normally absorb and replenish lost negative charge electrons and dissipate the accumulation of excess static electricity built-up in the body caused by numerous factors as are more fully set forth above in the Background of the Invention. Furthermore, grounding the body through this invention also helps to protect the body from positive build up of EMF's as a result of man made electrical current.

The grounding insert of the present invention may be integrated into an article of footwear in various ways including, as is more fully set forth below, integration into the midsole and the outersole.

Figure 3:
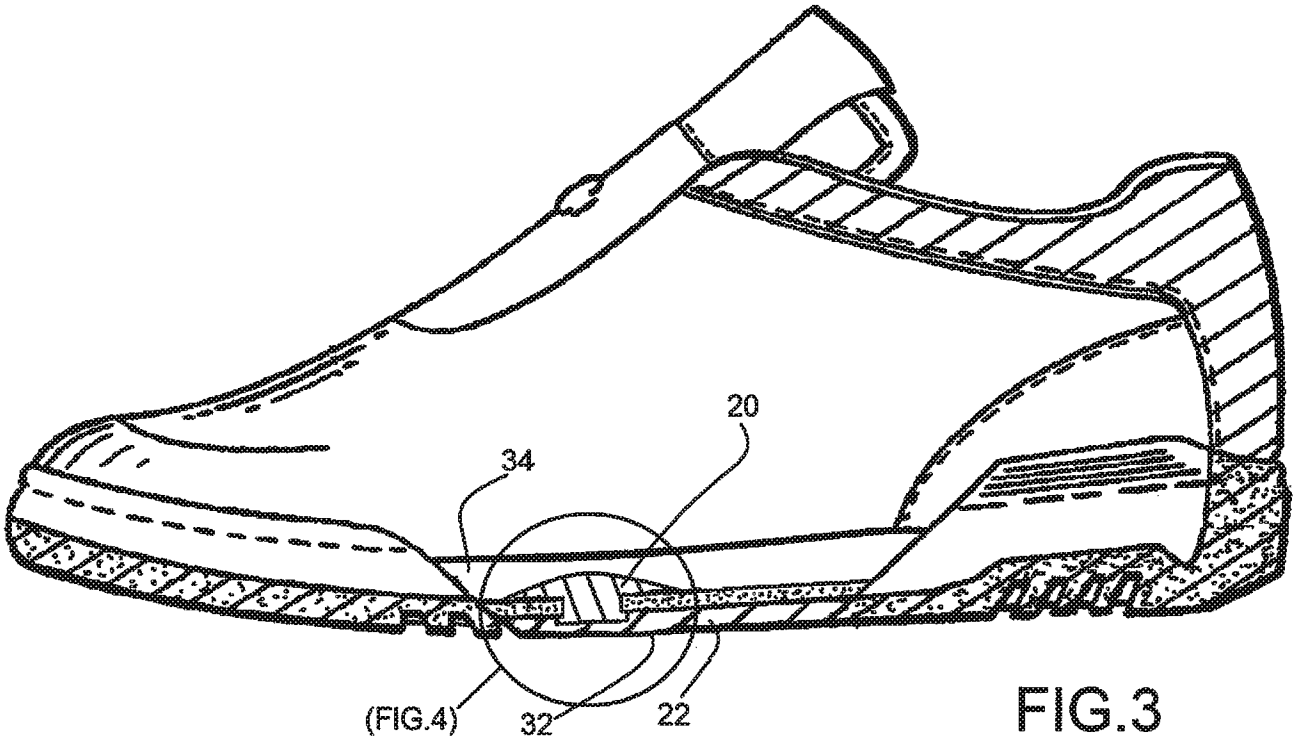
FIG. 3 is an electroconductive shoe.
Figure 4:
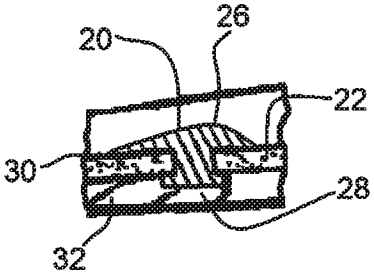
FIG. 4 is a major insert of the bottom of the shoe.
Figure 5:
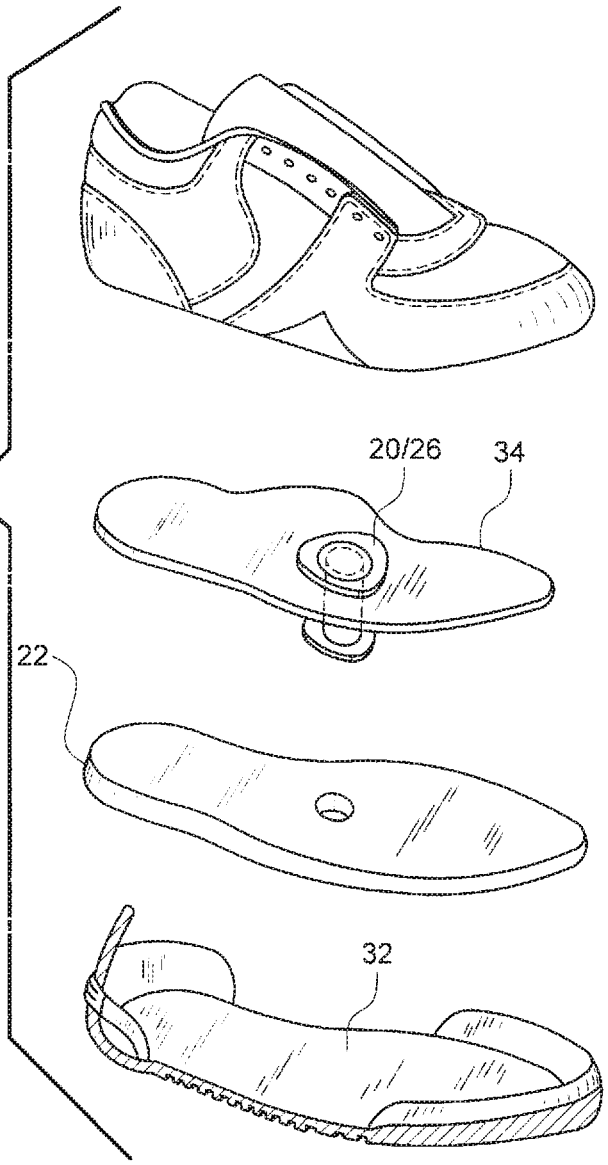
FIG. 5 is an exploded view of the shoe.
Figure 7:
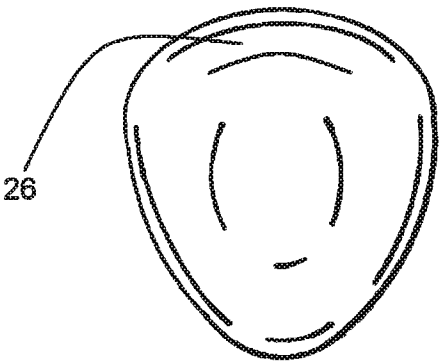
FIG. 7 is one embodiment of a metatarsal of the shoe.
Figure 12:
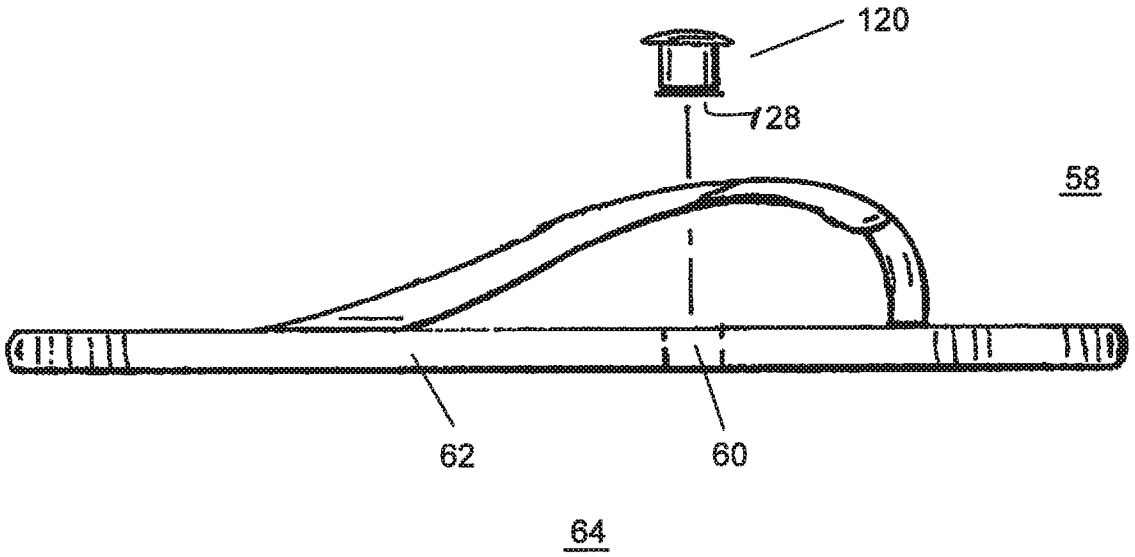
FIG. 12 is an embodiment of FIG. 3 but taken in the form of a sandal.
Figure 13:
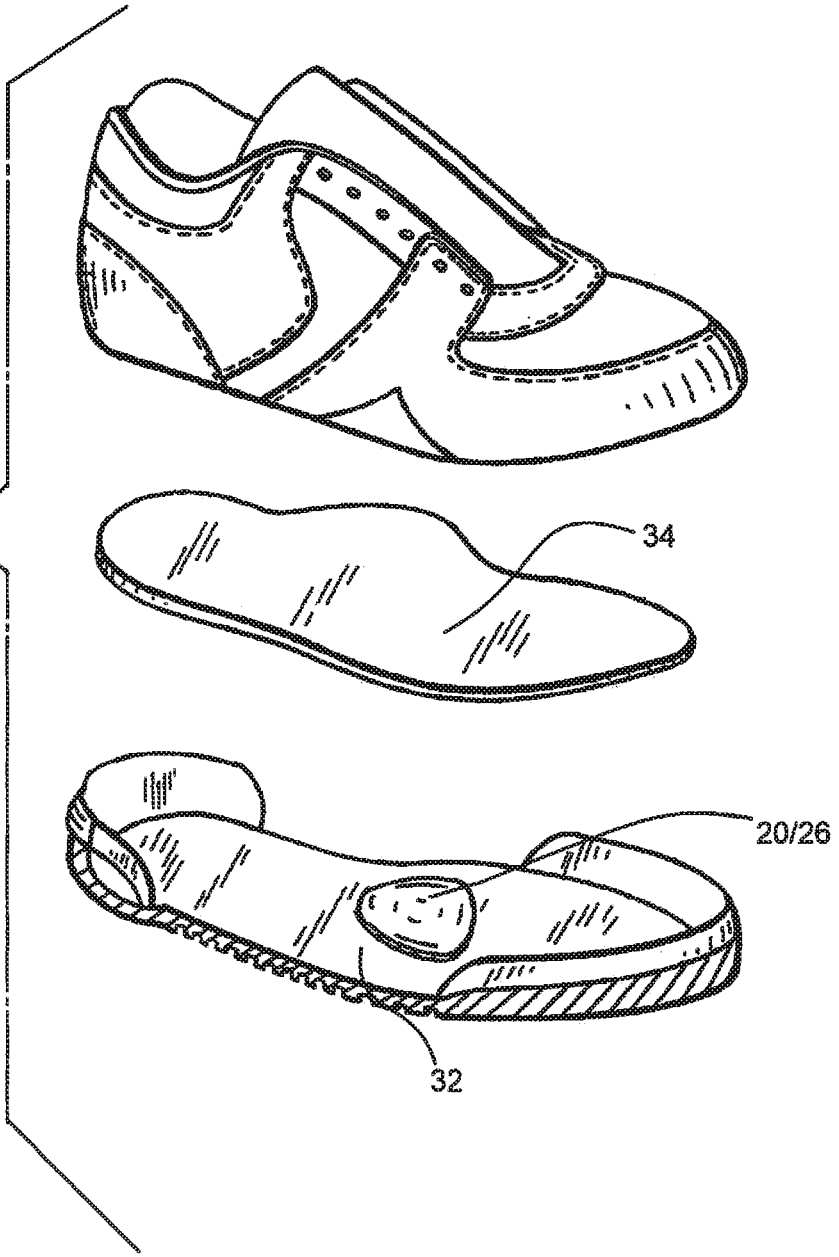
FIG. 13 is a further embodiment but showing in which, no midsole is used with the electroconductive insert thereof.

In FIGS. 3-5 is shown an embodiment of the invention in which an electro-conductive insert 20 is provided within an insole 22 for a static electricity discharging shoe 64. As may be appreciated, the geometry of the electro-conductive insert varies slightly from shoe-to-shoe but, in general, includes an upper major base 26 and a lower minor base 28 (see FIGS. 4 and 6) which are joined by a central cylindrical portion 30. The minor base may be similar in diameter to the central portion. See FIG. 9. From FIGS. 4 and 6 it may be appreciated that the central cylindrical portion 30 and lower minor base 28 serve to stabilize the insert within insole 22 while the upper major base 20 also acts as a pad opposite to the plantar metatarsal region of the sole of the foot. The lower minor base also rests upon the top of outersole 32, in the embodiment of FIGS. 3-8. The lower minor base also can touch the ground directly. See FIGS. 12-13

The upper major base of said electro-conductive insert is configured to be positioned opposite to the plantar metatarsal region of the sole of the foot proximally to the K-1 acupressure point when the foot abuts the insole. The upper major base of the electro-conductive insert defines the raised insert. The important function of this placement being that the K-1 acupressure point is a spot in the foot that is desirable for electrical conductivity in terms of less resistance. A theory behind the present invention seeks to exploit the region of the K-1 acupressure point as desirable, as the K-1 point does not callus as much as the heel or balls of the feet, and therefore provides less resistance to conductivity, making it the most advantageous spot.

As may be seen in FIGS. 3-9, the metatarsal pad defining upper major base 26 may, in one embodiment, be somewhat oval-shaped in its appearance. Inner sole 34 typically will then cover upper base 26 of the insert. The lower minor base also can touch the ground directly.

Figure 6:
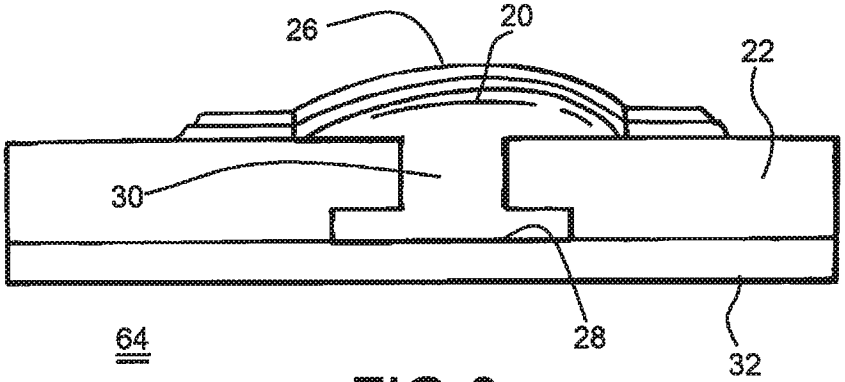
FIG. 6 is an upper major base.
Figure 8:
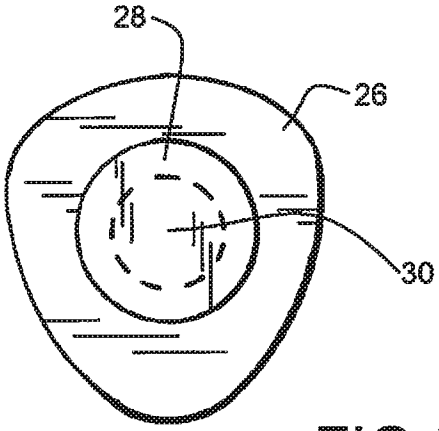
FIG. 8 shows the lower minor base of the embodiment of FIG. 7 and the lower minor base thereof.

The possible dimensional relationships between upper surface and pad 26, lower surface 28, and connecting integral cylindrical portion 30 is shown in FIGS. 6 an and 8. Thereafter, one may appreciate that the greatest dimension of said major base 26 of insert 20 to the greatest dimension of said minor base 30 is in the range of about 3:1 to about 1:1. It is noted that the reverse relationship of minor to major base dimensions may have utility. In the embodiment shown in FIGS. 1-6, at least a portion of the outer sole 32 must be in contact with insert 20 formed of suitable conductive material of one of the types set forth below in regard to the insert itself.

Figure 9:
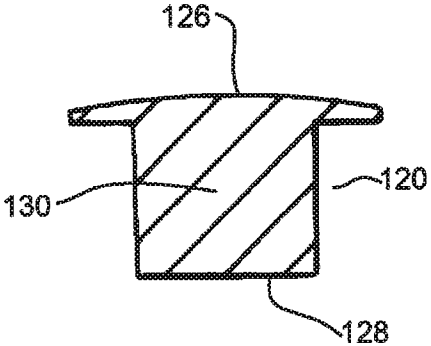
FIG. 9 is a cross-sectional diagonal central portion of FIG. 8.

Shown in FIG. 9 is a vertical cross-sectional view of a further embodiment 120 of insert 20 described above. Therein, the curvature upon the upper major base 126 of the insert is less than that described and shown above, particularly with reference to FIGS. 4 and 6. Also, in the embodiment of FIG. 9, central cylindrical portion 130 extends downwardly such that lower minor base 128 thereof possesses the same diameter as does central portion 130.

Figure 10:
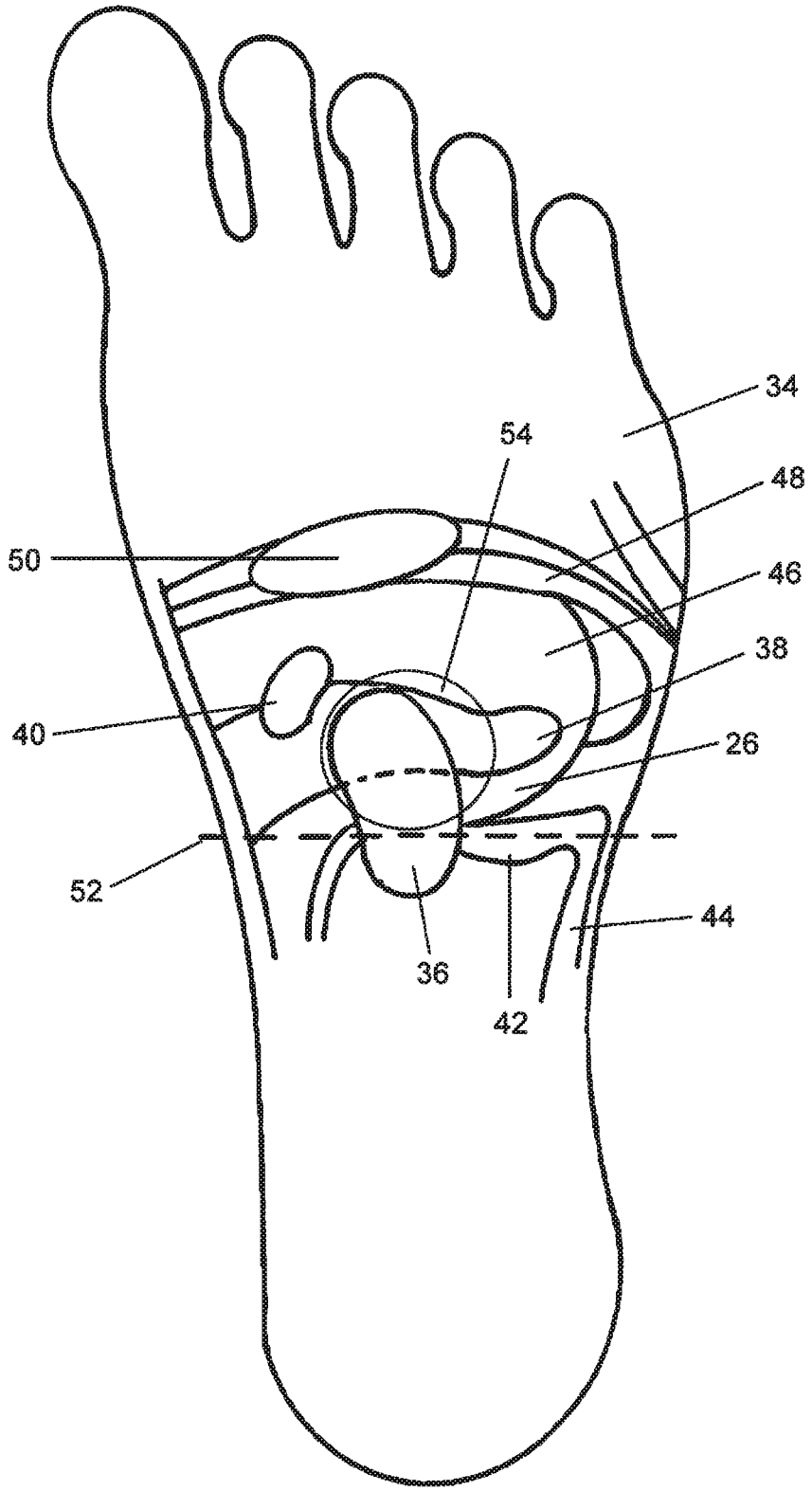
FIG. 10 is a platform sole of the human foot shown at its reflexology areas.

With reference to FIG. 10, there is shown the plantar sole of a human foot including the reflexology areas which are relevant to the present invention. More particularly, shown in FIG. 10 upon the plantar side proximal to the metatarsal area 34 of the foot is kidney region 36, pancreas region 38, adrenal region 40, colon region 42, spleen region 44, stomach region 46, diaphragm 48, and the solar plexus 50. Dotted line 52 corresponds to the nerve endings associated with the waist line.

FIG. 4 corresponds to the area shown in the circle 54 in FIG. 10 upon which major base 26 asserts pressure during the normal use of the inventive insert within a shoe provided therewith. This location is also known as the K1 or kidney 1 acupressure point and represents a major recognized entryway for the absorption of free electrons from the surface of the earth. See FIG. 1. As may be noted in FIG. 6. kidney region 36 is closely situated to pancreas region 38, adrenal region 40, stomach region 46, and colon region 42. As such, the pressure applied by upper major base or metatarsal pad 26 of the instant invention provides unique acupuncture and reflexology benefits to the human body through its use.

Yet further, the strategic metatarsal location of upper base 26 of the inventive insert provides for metatarsal off-loading in a region of the plantar surface of the foot which is prone to chronic and repetitive stresses. The instant invention therefore provides benefits at three distinct medical levels, namely, ground body conductivity, reflexology pressure at a strategic area, and the physiologic benefit of off-loading in the metatarsal heads of the sole of the foot.

Figure 11:
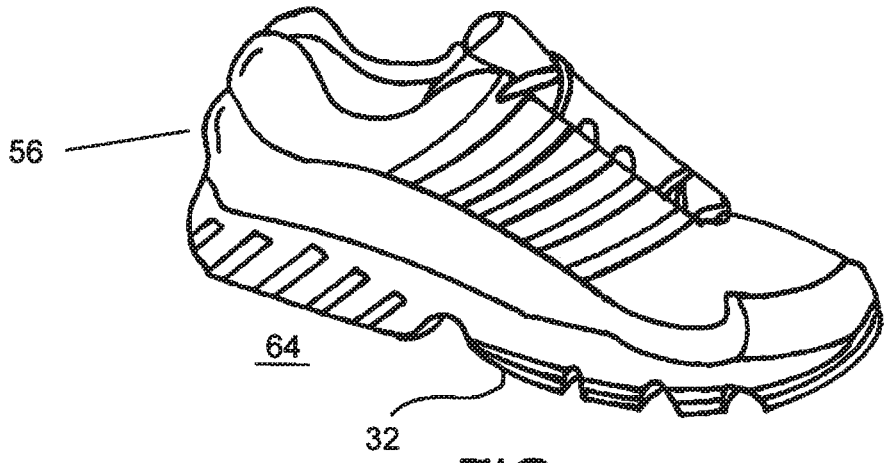
FIG. 11 is a complete shoe of the invention.

A complete shoe 56 is shown in FIG. 11.

With respect to the materials of which the insert is preferably formed, it has been found that an elastomeric or polymeric resilient material having a characteristic known as a Shore A, in a range of about 25 to about 80 degrees is preferable. Alternatively, an elastomeric or polymeric resilient material having a Shore C in a range of about 35 to about 65 degrees is also desirable.

Metal in the sole of a shoe, or even used as the conductive insert, is not desirable for comfort, while it may be conductive it does not yield to the levels of comfort that an elastomeric material might and the elastomeric material in the present invention is inherently conductive.

In the present application, the conductive insert makes direct contact with the foot of the user of the shoe, as it has been configured to do so, and therefore eliminates the need for any metallic foil sheet or integrated metallic insole component. In addition, this results in the manufacturing of the shoe being simplified and allows for a singular component to facilitate conductivity.

With respect to the significant factor of conductivity of the insert, as well as the outsole 32 where the outsole is in direct contact with the ground, the level of resistance (the inverse of conductivity) has been found to be critical in providing a suitable property of static electricity dissipation. Through experimentation, the inventors have found that an optimal point to point resistance falls in a range of about 1000 Ohms to about 100,000 Ohms. In other words, at a higher level resistance than that of a true conductive material such as a metal, but a lesser resistance than that of an insulator such as rubber or a typical polymer. As such, so-called static dissipative materials possess an electrical resistance which is between that of insulative and conductive materials. This provides an electron flow across or through such dissipative materials, but the same is controlled in large part by the surface resistance and volume resistance of the material. This resistance also provides for two-way flow, unlike the prior art. As with the other categories of materials of greater and lesser resistance, charge can be generated on a statistic dissipative material, however, like a true conductive material, the static dissipative material will allow the transfer of charge to ground to occur as well as to other conductive surfaces upon which a user may walk with shoes provided with the inventive insert. The transfer of charge from the static dissipative material will generally take longer than that of a conductive material of equivalent size or dimension. It has been found to be beneficial, respective of safety and efficiency in light of the objects of the present invention, in minimizing or reducing electro-static discharge between bodies as well as the dissipation of undesirable externally originating endogenous currents within the human body. In other words, the speed of transfer of static and undesirable non-static charge (endogenous current) has been found to be an important factor in optimizing the function of the insert for use in its grounding function. Physiological studies have shown that the level of electron transfer from the earth into the human body is optimized and most beneficial at between 1000 Ohms and 100,000 Ohms.

While there has been shown and described above the preferred embodiment of the instant invention it is to be appreciated that the invention may be embodied otherwise than is herein specific all shown and described and that, within said embodiment, certain changes may be made in the form and arrangement of the parts without departing from the underlying ideas or principles of this invention as set forth in the Claims appended herewith.

I claim:

1. A static electricity discharging article of footwear with a conductive link to ground, comprising:

a conductive insole configured to contact with a sole of a foot of a user, and a conductive outer sole configured to contact with a ground;

an electro-conductive, dissipative, raised insert, having an upper major and a lower minor base, an insert in electrical communication between said insole and said outer sole, said electro-conductive raised insert having a lateral geometry proportioned for complemental engagement within a mid-sole situated between said insole and said outer sole, a narrow middle portion of said electro-conductive raised insert secured within said mid-sole, said upper major base of said electro-conductive raised insert configured to be positioned opposite to the plantar metatarsal region of the sole of the foot proximally to the K-1 acupressure point when the foot abuts the insole, said upper major base of the said electro-conductive raised insert defining the raised insert;

said upper base of the insert defining a slightly raised pad having orthopedic-benefit in off-loading of metatarsal stresses on the foot in the area of said K-1 point; and said insert made of an elastomeric material having a Shore A hardness in a range of at or above 20 degrees to below 40 degrees.

2. The static electricity discharging article of footwear as recited in claim 1, said electro-conductive raised insert configured to be positioned proximal of the metatarsal in the direction of the heel.

3. The static electricity discharging article of footwear as recited in claim 2, in which a greatest dimension of said upper major base of said electro-conductive raised insert exhibits a dimension of 3:1 to 1:1 times that of the lower minor surface of said electro-conductive insert abutting said outer sole.

4. The article of footwear as recited in claim 3, said insert having a resistance in a range of 1000 Ohms to 100,000 Ohms.

5. The static electricity discharging article of footwear as recited in claim 2, exhibiting a central cylindrical neck portion smaller in diameter than that of the upper major base or lower minor base of the electro-conductive insert, said cylindrical neck portion secured proximally within a mid-sole of said article of footwear.

6. The static electricity discharging article of footwear as recited in claim 2, said electro-conductive raised insert having resistance in a range of 1000 Ohms to 100,000 Ohms.

7. The static electricity discharging article of footwear as recited in claim 1 exhibiting a central cylindrical neck portion smaller in diameter than the diameter of an upper major base or lower major base of the insert, said cylindrical portion secured proximally within a sole of said article of footwear.

8. The static electricity discharging article of footwear as recited in claim 1, said insert configured to be positioned slightly proximal to the metatarsal configured in a direction of the heel of the foot.

9. A method for conducting a two-way electrical conduit between body and ground through use of a static electricity discharging article of footwear with a conductive link to ground, comprising:

configuring a conductive insole of an article of footwear for contact with a sole of a foot of a user, and configuring a conductive outer sole of an article of footwear for contact with a ground;

providing a dissipative, raised, electro-conductive insert having an upper major and a lower minor base;

situating said electro-conductive insert between said insole and said outer sole, wherein said insole and said outsole are in electrical communication;

situating a mid-sole between said insole and said outer sole;

configuring said electro-conductive insert to have a lateral geometry proportioned for complemental engagement within said mid-sole, placing a narrow middle portion of said electro-conductive insert secured within said mid-sole, configuring said upper major base of said electro-conductive insert by positioning said upper major base of said electro-conductive insert opposite to the plantar metatarsal region of the sole of the foot proximally to the K-1 acupressure point when the foot abuts the insole, said upper major base of the electro-conductive insert defining the raised insert; and using an elastomeric material for said insert.

10. The method as recited in claim 9, further comprising positioning said electro-conductive insert proximal of the metatarsal in the direction of the heel.

11. The method as recited in claim 10 further comprising, forming said electro-conductive insert of an elastomeric or polymeric resilient material having a Shore A in a range of at or above 20 degrees to below 40 degrees.

12. The method as recited in claim 11, further comprising:

configuring said electro-conductive insert for a resistance in a range of 1000 Ohms to 100,000 Ohms.

13. The method as recited in claim 12, further comprising:

including a central cylindrical neck portion smaller in diameter than that of the upper major base or lower minor base of the electro-conductive insert; and securing said cylindrical neck portion proximally within a mid-sole of said article of footwear.

14. The method as recited in claim 12, further comprising:

forming said electro-conductive insert of an elastomeric or polymeric resilient material having a Shore C in a range of at or above 35 degrees to below 65 degrees.

15. The method as recited in claim 10 further comprising, configuring a greatest dimension of said upper major base of said electro-conductive insert to a dimension of 3:1 to 1:1 times that of the lower minor surface of said electro-conductive insert abutting said outer sole.

16. The method as recited in claim 15, further comprising:

configuring said electro-conductive insert for a resistance in a range of 1000 Ohms to 100,000 Ohms.

17. The method as recited in claim 10, further comprising:

including a central cylindrical neck portion smaller in diameter than that of the upper major base or lower minor base of the electro-conductive insert; and securing said cylindrical neck portion proximally within a mid-sole of said article of footwear.

18. The method as recited in claim 9, further comprising:

positioning said electro-conductive insert slightly proximal to the metatarsal configured in a direction of the heel of the foot.

19. A static electricity discharging article of footwear with a conductive link to ground, comprising:

a conductive insole configured to contact with a sole of a foot of a user, and a conductive outer sole configured to contact with a ground;

an electro-conductive, dissipative, raised insert, having an upper major and a lower minor base, an insert in electrical communication between said insole and said outer sole, said electro-conductive insert having a lateral geometry proportioned for complemental engagement within a mid-sole situated between said insole and said outer sole, a narrow middle portion of said electro-conductive insert secured within said mid-sole, said upper major base of said electro-conductive insert configured to be positioned opposite to the plantar metatarsal region of the sole of the foot proximally to the K-1 acupressure point when the foot abuts the insole, said upper major base of the electro-conductive insert defining the raised insert;

said upper base of the insert defining a slightly raised pad having orthopedic-benefit in off-loading of metatarsal stresses on the foot in the area of said K-1 point; and said insert made of an elastomeric material having a Shore C hardness in a range of at or above 35 degrees to below 65 degrees.

* * * * *